US010506690B2

(12) United States Patent
Chen

(10) Patent No.: US 10,506,690 B2
(45) Date of Patent: Dec. 10, 2019

(54) CONTROL OF MODULAR LIGHTED ARTIFICIAL TREES

(71) Applicant: Willis Electric Co., Ltd., Taipei (TW)

(72) Inventor: Johnny Chen, Taipei (TW)

(73) Assignee: Willis Electric Co., Ltd., Taipei (TW)

( * ) Notice: Subject to any disclaimer, the term of this patent is extended or adjusted under 35 U.S.C. 154(b) by 0 days.

(21) Appl. No.: 15/851,425

(22) Filed: Dec. 21, 2017

(65) Prior Publication Data

US 2018/0184505 A1 Jun. 28, 2018

Related U.S. Application Data

(63) Continuation of application No. 14/702,224, filed on May 1, 2015, now Pat. No. 9,883,566.

(60) Provisional application No. 61/987,160, filed on May 1, 2014.

(51) Int. Cl.

| | |
|---|---|
| ***H05B 37/02*** | (2006.01) |
| ***F21V 33/00*** | (2006.01) |
| ***F21V 23/06*** | (2006.01) |
| ***F21V 23/00*** | (2015.01) |
| ***H05B 33/08*** | (2006.01) |
| ***A47G 33/06*** | (2006.01) |
| ***F21S 4/10*** | (2016.01) |
| ***F21S 4/15*** | (2016.01) |
| *F21W 121/04* | (2006.01) |

(52) U.S. Cl.

CPC ..... *H05B 37/0272* (2013.01); *A47G 33/06* (2013.01); *F21S 4/10* (2016.01); *F21S 4/15* (2016.01); *F21V 23/001* (2013.01); *F21V 23/06* (2013.01); *F21V 33/0028* (2013.01); *H05B 33/0845* (2013.01); *H05B 33/0857* (2013.01); *F21W 2121/04* (2013.01)

(58) Field of Classification Search

CPC ..... H05B 37/0272; H05B 33/0845; H05B 33/0857; F21S 4/10; F21S 4/002; F21S 4/00; A47G 33/06; A47G 33/04; A47G 2033/0827; F21V 23/001; F21V 23/06; F21V 33/0028; F21V 23/003; F21V 23/00; F21V 23/02; F21V 23/04; F21W 2121/04

See application file for complete search history.

(56) References Cited

U.S. PATENT DOCUMENTS

| | | | | |
|---|---|---|---|---|
| 7,878,678 | B1 * | 2/2011 | Stamatatos | B60Q 1/2611 116/63 P |
| 9,593,831 | B2 * | 3/2017 | Yu | F21V 23/06 |
| 2002/0057886 | A1 * | 5/2002 | Ando | G11B 27/034 386/241 |

(Continued)

*Primary Examiner* — Bao Q Truong

(74) *Attorney, Agent, or Firm* — Christensen, Fonder, Dardi & Herbert PLLC

(57) ABSTRACT

A lighting power and control system for an artificial lighted tree. The system includes: a first primary controller including a processor; a first plurality of sub-controllers, each including a processor, each of the first plurality of sub-controllers in electrical communication with the first primary controller; and a first plurality of lighting elements, each of the first plurality of lighting elements in direct electrical communication with one of the first plurality of sub-controllers. The first primary controller controls each of the first plurality of sub-controllers, and each of the first plurality of sub-controllers selectively powers the plurality of lighting elements according to commands issued by the primary controller.

16 Claims, 10 Drawing Sheets

(56) References Cited

U.S. PATENT DOCUMENTS

2002/0130627 A1* 9/2002 Morgan ..... F21V 33/004
315/291

* cited by examiner

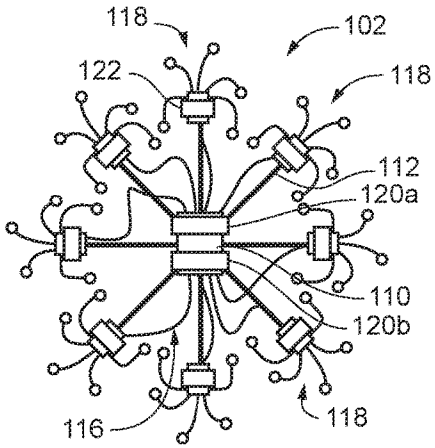
FIG. 6
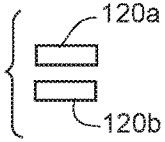
FIG. 7
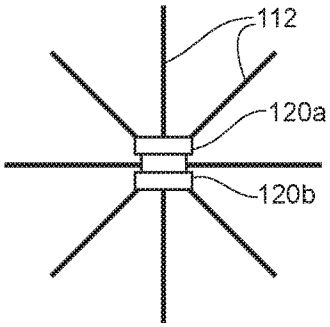
FIG. 8
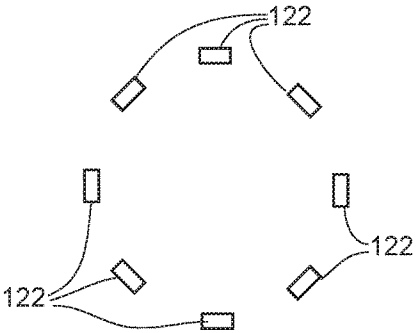
FIG. 9
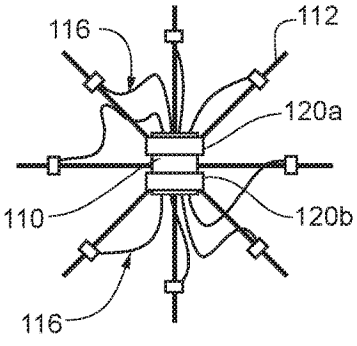
FIG. 10
FIG. 11
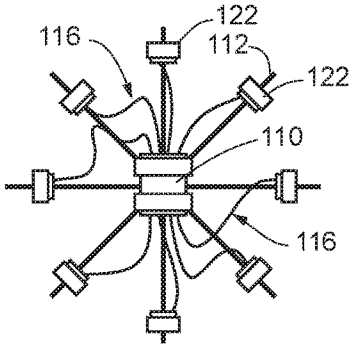
FIG. 12
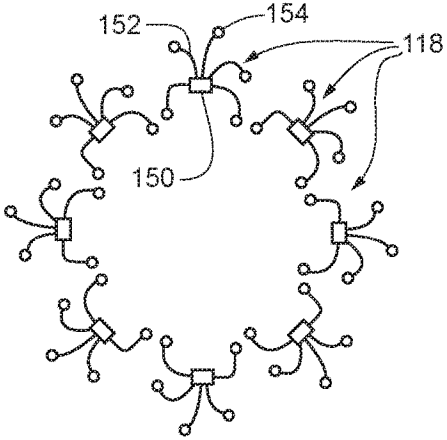
FIG. 13

CONTROL OF MODULAR LIGHTED ARTIFICIAL TREES

CROSS-REFERENCE TO RELATED APPLICATIONS

The present application is a continuation of U.S. patent application Ser. No. 14/702,224, filed May 1, 2015, which claims the benefit of Provisional Application No. 61/987,160, filed May 1, 2014, which is incorporated herein in its entirety by reference.

FIELD OF THE INVENTION

The present invention is generally directed to lighted artificial trees. More specifically, the present invention is directed to controlling electronic features, including lights, of lighted artificial trees having multiple tree and trunk sections.

BACKGROUND OF THE INVENTION

Artificial lighted trees often include decorative light strings distributed about the branches of the trees. Such decorative light strings may be of the traditional type having power plugs that may be connected to one another, and to an external power supply. Such well known configurations require that multiple power plugs of multiple light strings be plugged in, resulting in a web of wires wound about the branches of the tree.

Not only are such traditional systems tedious to assemble, but such systems provide limited control of the individual light strings and their lamps.

SUMMARY OF THE INVENTION

An embodiment of the invention includes a lighting power and control system for an artificial lighted tree, the system comprising: a first primary controller including a processor, a first plurality of sub-controllers, each including a processor, each of the first plurality of sub-controllers in electrical communication with the first primary controller; a first plurality of lighting elements, each of the first plurality of lighting elements in direct electrical communication with one of the first plurality of sub-controllers; wherein the first primary controller controls each of the first plurality of sub-controllers, and each of the first plurality of sub-controllers selectively powers the plurality of lighting elements according to commands issued by the primary controller.

Another embodiment comprises an artificial lighted tree for powering and controlling electrically powered lighting elements, the tree comprising a first tree portion and a second tree portion. The first tree portion includes: a first trunk portion; a first plurality of branches coupled to the first trunk portion; a first plurality of lighting elements distributed about the first plurality of branches; a first trunk electrical connector inserted at least partially into the first trunk portion and including at least three electrical terminals; a first set of power wires in electrical connection with the first trunk electrical connector and the primary controller; a first primary controller including a processor, the first primary controller in electrical connection with the first set of power wires and the first plurality of lighting elements, and in electrical connection with at least one of the three electrical terminals of the first trunk electrical connector. The second tree portion includes: a second trunk portion; a second plurality of branches coupled to the second trunk portion; a second plurality of lighting elements distributed about the second plurality of branches; and a second trunk electrical connector inserted at least partially into the second trunk portion and including at least three electrical terminals, the three electrical terminals configured to electrically connect to the three electrical terminals of the first trunk connector. The first tree portion is configured to couple to the second tree portion such that the first trunk electrical connector engages the second trunk electrical connector enabling power to be transmitted from the first tree portion to the second tree section, and enabling data from the primary controller to be transmitted to the second tree section.

Another embodiment comprises an artificial lighted tree for powering and controlling electrically powered lighting elements, the tree comprising a first tree portion and a second tree portion. The first tree portion includes: a first trunk portion; a first plurality of branches coupled to the first trunk portion; a first plurality of lighting elements distributed about the first plurality of branches; a first trunk electrical connector inserted at least partially into the first trunk portion and including at least three electrical terminals; a first set of power wires in electrical connection with the first trunk electrical connector. The a second tree portion includes: a second trunk portion; a second plurality of branches coupled to the second trunk portion; a second plurality of lighting elements distributed about the second plurality of branches; and a first trunk electrical connector inserted at least partially into the second trunk portion and including at least three electrical terminals, the three electrical terminals configured to electrically connect to the at least three electrical terminals of the first trunk connector; a second trunk electrical connector inserted at least partially into the second trunk portion and including a plurality of electrical terminals, the second trunk electrical connector having fewer electrical terminals as compared to the first trunk electrical connector. The first tree portion is configured to couple to the second tree portion such that the first trunk electrical connector of the first tree portion engages the first trunk electrical connector of the second tree portion, thereby enabling power to be transmitted from the first tree portion to the second tree portion.

BRIEF DESCRIPTION OF THE FIGURES

The invention can be understood in consideration of the following detailed description of various embodiments of the invention in connection with the accompanying drawings, in which:

FIG. 6 depicts a two-controller control system mounted on a tree, according to an embodiment;

FIG. 7 depicts a pair of controllers of the tree section of FIG. 6;

FIG. 8 depicts the pair of controllers of the tree section of FIG. 7 mounted to a tree, according to an embodiment;

FIG. 9 depicts secondary controllers distributed about the tree section of FIG. 6, according to an embodiment;

FIG. 10 depicts a wiring distribution layout of two primary wiring assemblies of the tree section of FIG. 6;

FIGS. 11 and 12 depict primary controllers and primary wiring assemblies mounted to a tree;

FIG. 13 depicts a distribution scheme for multiple lighting assemblies, according to an embodiment;

Figure 1:
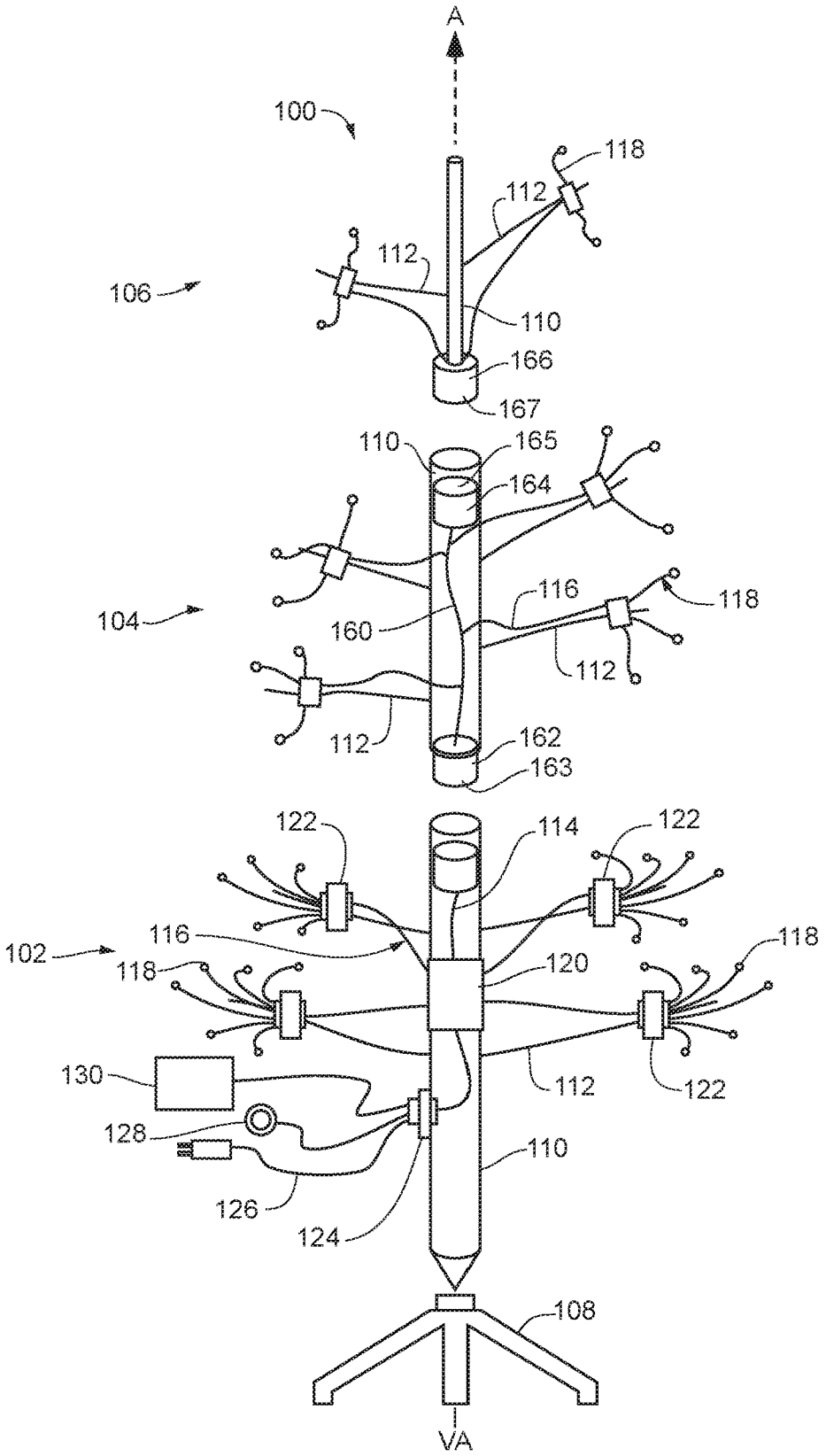
FIG. 1 is a front view of a controllable lighted artificial tree according to an embodiment.
Figure 3:
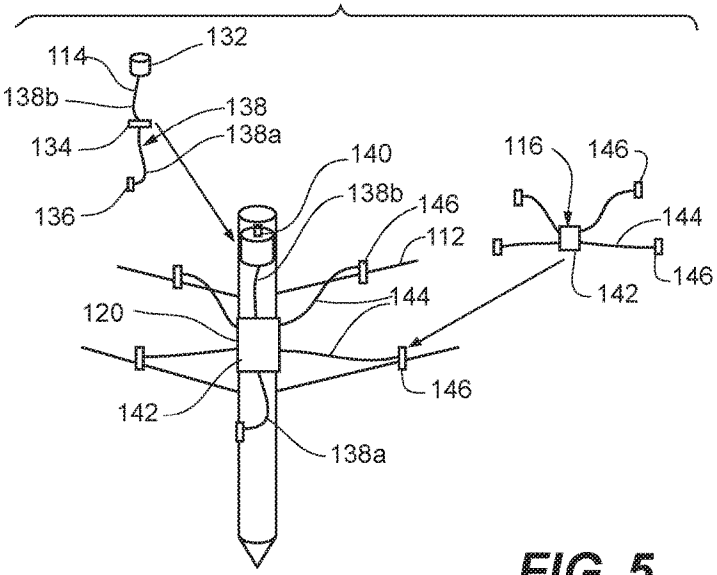
FIG. 3 is another view of the tree section of FIG. 2, with selected components shown.
Figure 5:
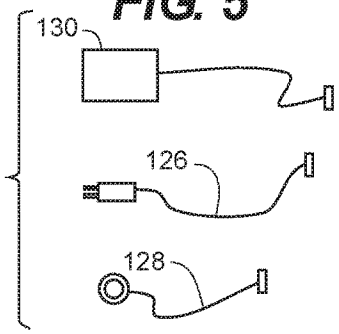
FIG. 5 depicts optional control components of the tree of FIG. 1.
Figure 2:
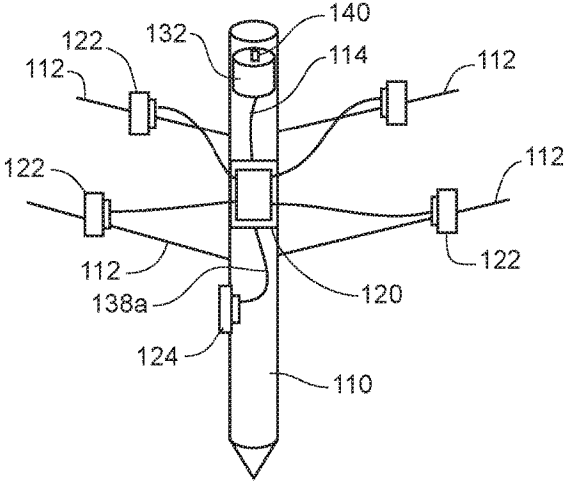
FIG. 2 is a front view of a first tree section of the tree of FIG. 1, according to an embodiment.
Figure 4:
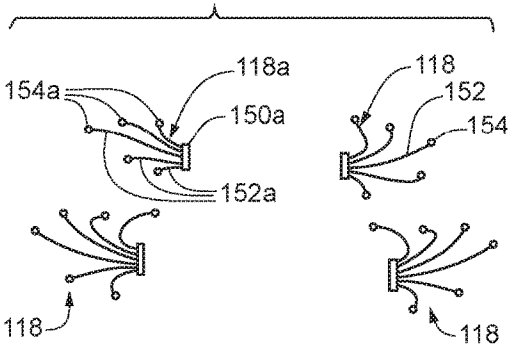
FIG. 4 depicts lighting harness of the tree of FIG. 1, according to an embodiment.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Referring to FIG. 1, an embodiment of controllable lighted artificial tree 100 is depicted. Tree 100 includes multiple tree sections, which as depicted, includes first section 102, second section 104 and third section 106. As depicted, first tree section 102 comprises a lower section tree, second tree section 104 comprises a middle section, and third tree section 106 comprises an upper tree section. Although three tree sections are depicted, it will be understood that lighted artificial tree 100 may comprise more or fewer tree sections, such as one section, two sections, four sections, and so on.

In an embodiment, tree 100 may also include tree stand 108 configured to support tree 100 in an upright position along vertical Axis A.

As will be described further below, each tree section joins to one or more adjacent tree sections both mechanically and electrically along Axis A to form completed tree 100. As will also be described further below, lights of tree 100 may be controlled by a master or primary controller, and in some cases, also controlled by multiple sub-controllers to create various lighting effects. Embodiments of the invention include efficient wiring layouts and assemblies or harnesses that facilitate modular construction of tree 100 as well as extensive control over individual tree lights.

Referring also to FIGS. 2-5, in an embodiment, tree section 102 includes trunk portion 110, branches 112 coupled to trunk 110, trunk wiring assembly 114, one or more primary wiring assemblies 116, a plurality of lighting wiring assemblies 118, one or more primary controllers 120, a plurality of secondary controllers 122, power interface portion 124, and power cord 126. In an embodiment, and as depicted, tree 100 may also include control switch 128 and wireless receiver 130.

For the sake of illustration, in FIGS. 1-5, wiring assemblies are simplified such that wire connections are depicted as a single line connecting two elements, though it will be understood that such wire connections may comprise two, three, four, or more conductors or wires for conducting power and/or data.

Trunk portion 110 may comprise a generally hollow, cylindrical structure as depicted, though in other embodiments, trunk portion 110 may be generally solid, with cavities for receiving portions of wiring and componentry. One end of trunk portion 110 may be narrower than another end of trunk portion 110 so as to be inserted into a trunk portion of an adjacent tree section; alternatively, an end of trunk portion 110 may receive a narrower end of a trunk portion of an adjacent tree section.

Branches 112 are connected or coupled to trunk portion 110. In an embodiment, branches 112 are pivotally connected to trunk portion 110 about a hinge or other pivot point. In an embodiment, light strings, light sets, and light elements are distributed upon an exterior of branches 112, as will be described further below.

Trunk wiring assembly 114, in an embodiment, comprises trunk electrical connector 132, controller connector 134, junction connector 136, and trunk wire set 138. In an embodiment, trunk wire set 138 may comprise a plurality of wires or conductors. In one such embodiment, trunk wire set 138 includes wire set **138*a* connecting junction connector 136 to controller connector 134 and wire set 138*b* connecting controller connector 134 to trunk electrical connector 132. In an embodiment, each of wire set 138*a* and 138*b* comprise two or more electrical conductors. In one such embodiment, each wire set 138*a* and 138*b* comprise a ground conductor and a power conductor. In an embodiment, each wire set 138*a* and 138*b*** also comprises one or more conductors for transmitting communication data.

In an embodiment, trunk wiring assembly 114 is located substantially entirely within a cavity formed by trunk portion 110. In another embodiment, portions of trunk wiring assembly 114 may be located outside trunk portion 110, such as portions of trunk electrical connector 132, which may extend partially outside an end of trunk portion 110, a portion of control connector 134 which may extend through an opening of trunk portion 110 to connect to controller 120, and so on.

Trunk electrical connector 132 includes electrical terminal set 140, electrically connected to trunk wire assembly 138. Trunk electrical connector 132 and its terminal set 140 are configured to couple to a corresponding trunk electrical connector and terminal set of second tree section 104, thereby electrically connecting tree section 102 and 104, and their respective trunk wiring assemblies.

Controller connector 134 comprises an electrical connector with conductive terminals electrically connected to trunk wire set **138*b*. Controller connector 134 couples to controller 120 to electrically connect wire set 138*b* and trunk electrical connector 132 to controller 134. In an embodiment, controller connector 134 connects to controller 120 within an interior of trunk portion 110**.

Junction connector 136, comprises an electrical connector with conductive terminals electrically connected to trunk wire set **138*a*. Junction connector 136 couples to power interface portion 124 to make an electrical connection between wire set 138*a* and power interface portion 124, thereby also electrically connecting power interface portion 124 to controller 120**.

Primary wiring assembly 116 includes central connector or interface 142, a plurality of wire sets 144, and a plurality of secondary controller connectors 144. In an embodiment, primary wiring assembly 116 is substantially on an exterior portion of tree section 102. Interface 142 is configured to interface or connect to primary controller 120 to electrically connect connector wire sets 144 and their respective connectors 146 to primary controller 120. Wire sets 144 may comprise a pair of conductors, such as first and second power transmission conductors, and may also include additional data transmission wires. Connectors 146 are configured to electrically connect wire sets 144 to subcontrollers or secondary controllers 122, and thereby electrically and communicatively connect primary controller 120 with secondary controllers 122.

In an embodiment, primary wiring assembly 116 couples to master controller 120 and may couple directly or indirectly to trunk portion 110. Connectors 146 may couple directly or indirectly to branches 112.

In an embodiment, tree section 102 includes a single primary wiring assembly 116. In an alternate embodiment, as depicted in FIGS. 6-13, tree section 102 may include more than one primary wiring assembly 116.

Referring still to FIGS. 1-5, tree 100 and tree section 102 includes a plurality of lighting wire assemblies 118. In an embodiment, each lighting wiring assembly 118 includes connector 150, lighting wire set 152 and lighting element 154.

Connectors 150 electrically and mechanically connect lighting wire sets 152 to respective connectors 146 of primary wiring assembly 116. In an embodiment, each connector 146 electrically connects multiple wire sets 152 such that all light elements 154 are electrically connected. In one such embodiment, all light elements 154 receive the same electrical signal from a secondary controller 122. In one such embodiment, all light elements 154 for a lighting wire assembly 118 would be powered on and off at the same time. In another such embodiment, although a common signal is received, light elements 154 receive a communication signal that selectively turns individual light elements 154 on and off in a predetermined manner.

Lighting wire sets 152 may include a plurality of conductors, such as a pair of power conducting wires and in some embodiments, additional conductors dedicated to communicating data from secondary controller 122 and/or primary controller 120.

Light elements 154 may comprise any of a variety of lights or lamps, such as incandescent bulbs, light-emitting diodes, and so on. Light elements 154 may also include light or lamp holders for connecting lamps to wire sets. In an embodiment, the lamp holders may comprise a housing and conductive terminals, and in some embodiments, a lens cover.

As will be described further below with respect to FIGS. 6-13, lighting wire assemblies 118 may be distributed about branches 112.

In an embodiment, primary controller 120 comprises may include a housing, PC board and in some embodiments, a selector switch. PC board 140 may include power conditioning electronics, including a voltage regulator and so on, a controller such as a microcontroller, microprocessor, processor, or similar, as well as memory, and other control electronics. A selector switch, such as a switch integral to controller 120, or an external switch, such as switch 128, may be in communication with the PC board and controller may comprise a rotary, pushbutton, or similar switch operable by a user.

In an embodiment, tree 100 and tree section 102 comprise a single primary controller 120. In another embodiment, tree 100 and tree section 102 comprise a pair of primary controllers, or even multiple primary controllers 120. In one such embodiment, tree section 102 includes two primary controllers 120; in an embodiment the two controllers are in communication with each other; in an embodiment, one of the two controllers controls the other controller, serving as a master controller or master primary controller.

In an embodiment, tree 100 and tree section 102 may include a plurality of secondary controllers 122, as depicted. In an alternate embodiment, tree 100 and tree section 102 does not include any secondary controllers 122, but rather, controls light elements 154 via one or more primary controllers 120, one of which may be a master controller. Secondary controllers 122 may include power conditioning electronics, a controller such as a microcontroller, microprocessor, or similar, memory, and other control electronics. In an embodiment including power conditioning electronics, secondary controllers 122 include voltage regulators for regulating and adjusting voltage delivered to light elements 154.

As will be discussed further below, primary controller 120 and/or secondary controllers 122 may include software programs having stored algorithms for controlling light elements 154 of tree 100. In an embodiment, groups of light elements 154 corresponding to individual lighting assemblies 118 are controlled separately by group. In another embodiment, each light element 154 may be controlled individually to create various lighting effects.

Power interface portion 124 may comprise a junction box, panel, or other mechanical and electrical interface. In an embodiment power interface portion 124 is mounted to, or otherwise coupled to, trunk portion 110. In other embodiments, power interface portion 124 may not be coupled to trunk portion 110; in one such embodiment, power interface portion 124 may be connected.

In an embodiment, power interface portion 124 comprises a housing and conductive terminals, and is configured to receive a conductive end of power cord 126, and optional components such as control switch 128 and wireless receiver 130. Power interface portion 124 may also be configured to receive audio input from an external source, via a wired or wireless connection. In one such embodiment, power interface portion 124 includes audio jacks for receiving a cord from device transmitting an audio data signal, the signal being transmitted to controller 120.

Power interface portion 124 is in electrical communication with primary controller 120 via wire set 138*a*.

In an embodiment, power cord 126 includes a pair of conductors, and is configured to transmit or conduct power received from an external power source. In an embodiment, power cord 126 directly transmits power received to master controller 120 or other portions of tree 100. In one such embodiment, power cord 126 is configured to transmit alternating-current (AC) power, and as such, may have limited or no power conditioning circuitry. In an alternate embodiment, power cord 126 may include power-conditioning or transforming circuitry for transforming an incoming power from the external power source to an outgoing power for use by tree 100. In one such embodiment, power cord 126 transforms incoming AC power to outgoing direct-current (DC) power.

In an embodiment, tree 100 includes control switch 128. Control switch 128 may comprise a foot-pedal activated switch as depicted, or in other embodiments, may comprise other switch configurations and components. Control switch 128 may be modular in nature, and in some cases, removably attached to power interface portion 124, thereby communicatively coupling control switch 128 to tree 100, and in some embodiments, to primary controller 120. In an embodiment, control switch 128 may be used to turn power on and off, or may be used to select various functions of tree 100, such as light display functions, musical functions, combinations thereof, and other functions relating to lights, sound and possibly movement.

Wireless receiver 130, in an embodiment, may be modular in nature, and in some cases removably, or otherwise attached to power interface portion 124. In an embodiment, wireless receiver 130 includes wiring 160, connector 162, and receiver portion 164. In an embodiment, wiring 160 defines a length of wiring that allows receiver portion 164 to be placed in a position for maximum reception, such as at a branch end away from trunk portion 110, or near a top or bottom portion of tree 100, unobstructed from branches, or some other convenient location.

Wireless receiver 130 may comprise a receiver or transceiver, and may be configured to operate over any of a number of known wireless networks using known wireless protocols, including radio-frequency, infrared, Bluetooth, Wi-Fi, Z-Wave, ZigBee, and so on. In an embodiment, wireless receiver 130 is configured to receive a wireless signal from an external remote control device, such as a smartphone or other remote controller, and to transmit the received signal, including data, to primary controller 120.

Referring to FIGS. 6-13, top plan views of tree section 102 and its wiring assemblies are depicted.

Referring specifically to FIG. 6, a top plan of tree section 102 is depicted. In this embodiment, tree section 102 includes two primary controllers 120. In an embodiment, the two primary controllers 120 are in communication with one another; in one such embodiment, one of the two controllers 120 controls the other controller, serving as a master controller.

As depicted, the wiring layout for tree section 102 is particularly efficient. In this embodiment, a wiring system for tree section 102 is split into two primary wiring assemblies 116, each communicatively coupled to a primary controller 120, such that approximately half of light elements 154 are controlled by one controller 120, and the other half controlled by the other controller. In an embodiment, tree 100 comprises only one true master primary controller 120, such that a second primary controller 120 is actually a sub-controller 120*b* under the control of master primary controller 120*a*. In such an embodiment, there are three levels of controllers: master primary controller 120*a*, one or more primary controllers 120*b*, and multiple secondary controllers 122, for a multi-tiered control system.

In an embodiment, each primary wiring assembly is communicatively coupled to multiple secondary controllers 122 and associated multiple lighting assemblies 118.

In an embodiment, each branch has one lighting assembly 118 and one secondary controller; in other embodiments, lighting assemblies 118 may be associated with more than one branch 112, or one branch may have more than one lighting assembly 118.

Because multiple light elements 154 of a light assembly 118 are controlled by, or communicate through, a primary wire set 144, the number of wires needed to attach a primary controller 120 is minimized. If each light element 154 were to have its own wires connecting to a master controller 120, the amount of wiring in tree section 102 would be vastly increased, and much more complicated.

Referring to FIGS. 7 and 8, a pair of master controllers 120 are depicted, one on each side of tree section 102.

Referring to FIG. 9, secondary controllers 122 are distributed about tree section 102. In an embodiment, secondary controllers 122 are distributed approximately equidistantly from one another. In an embodiment, secondary controllers 122 are located at approximately the same height relative to the ground upon which tree 100 is placed; in another embodiment, secondary controllers 122 are located at different heights of tree section 102 so as to be mounted on branches of different heights.

FIG. 10 depicts a wiring distribution layout or configuration of two primary wiring assemblies 116. As depicted, each primary wiring assembly 116 is positioned so as to allow each wire set 144 to be attached to, placed adjacent to, or near, one or more branches 112.

FIGS. 11 and 12 further depict primary controllers 120 and primary wiring assemblies 116 attached to trunk portion 110 and branches 112.

FIG. 13 depicts an embodiment of a distribution scheme for multiple lighting assemblies 118.

Referring again to FIGS. 1-3, in an embodiment, a master controller 120 is placed on trunk portion 110 at a location above a first set of branches 112 at a first height, and below a second set of branches 112 at a second height, such that some wires 144 are positioned above connector 142, and some below.

Figure 14:
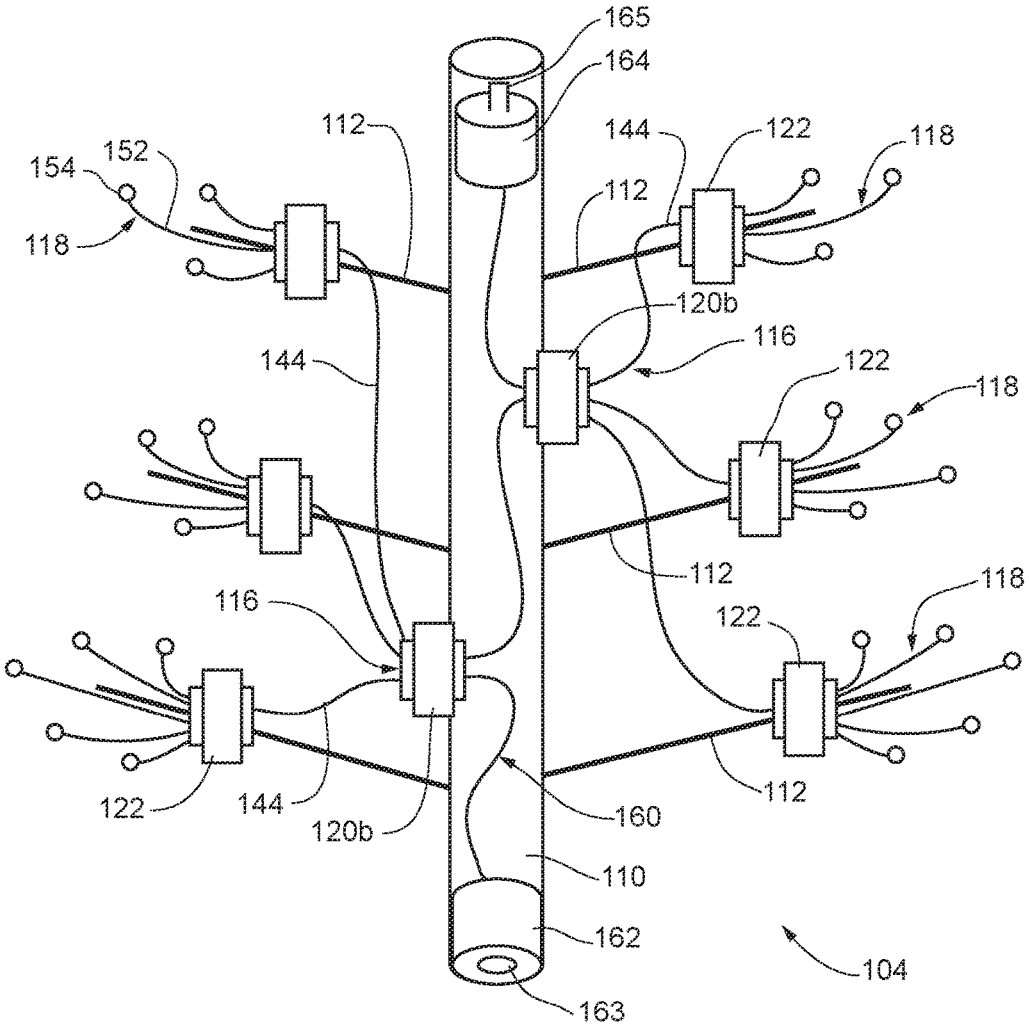
FIG. 14 depicts an embodiment of a tree section with a power interface portion, according to an embodiment.

Referring to FIG. 14, an embodiment of tree section 104 is depicted. Tree section 104, in an embodiment, includes many of the components of tree section 102, with the exception of power interface portion 124. Tree section 104 also includes a somewhat different trunk wiring assembly 160, as compared to trunk wiring assembly 114.

In this embodiment, trunk wiring assembly 160 includes first trunk electrical connector 162 with electrical terminals 163 and second trunk electrical connector 164 with electrical terminals 165. In an embodiment, trunk electrical connector 164 configured to mechanically and electrically connect to trunk electrical connector 132. In an embodiment trunk electrical connector 162 is similar to trunk electrical connector 132, but is configured to connect to trunk electrical connector 164 when tree section 102 is coupled to tree section 104 along trunk portion 100 and Axis A, such that the electrical terminals 140 and 163 make electrical connection, thereby electrically connecting trunk wiring assembly 114 to trunk wiring assembly 160.

When tree section 104 is coupled to tree section 102, power and in some cases, communication data, is transferred through trunk electrical connector 160 to primary controllers 120, and to trunk electrical connector 164 and its electrical terminals 165.

Referring again to FIG. 1, tree section 106 is configured to couple to tree section 104, such that trunk electrical connector 166 connects to trunk electrical connector 164, such that terminals 165 are in electrical connection with terminals 166.

When tree section 102 is coupled to tree section 104, and tree section 106 is coupled to tree section 104, power is transmitted throughout tree 100 to all three sections. In an embodiment, data relating to the control of light elements 154 is also transmitted throughout tree 100. In an embodiment, separate data is not transmitted to light elements 154, though light elements 154 may be turned on and off by transmitting or interrupting power to light elements 154.

In an embodiment, tree section 104 includes two primary controllers 120*b*, which may be subcontrollers controlled by master controller 120*b* of tree section 102.

Once assembled, in operation, light elements 154 may be controlled in groups or individually by a combination of primary controllers 120 commanding secondary controllers 122 to selectively turn light elements 154 on and off, or to control other functions of light elements 154. In an embodiment, selected light elements may be controlled to randomly turn on and off to create a twinkling effect; voltage to selected light elements 154 may be controlled, such as by ramping up or down, to create a "fade" effect, wherein the brightness of light element 154 is varied. Other visual effects may be created as each light element 154, or group of light elements of lighting assembly 118, is controlled.

In an embodiment, light elements 154 may comprise one or more LEDs. In one such embodiment, each light element 154 includes multiple LEDs, such as one red, one green, and one blue, or an RGB diode set. In an embodiment, primary controller 120 and/or secondary controller 122 may control such a light element 154 to create a variety of color combinations. If all light elements 154 comprise such RGB diode sets, then an entire tree can be made to change color.

When light elements 154 are wired and controlled individually, no mechanical or electrical bypass shunts or mechanisms are needed to keep other light elements 154 from losing power in the case of a single bulb being defective.

As described above, control of light elements 154 is accomplished by a "tiered" set of controllers, with one master primary controller 120 controlling one or more subcontrol primary controllers 120, and each subcontrol primary controller controlling multiple secondary controllers 122. Each secondary controller 122 controls a group of light elements, either collectively, in sub groups, or individually, to create nearly any lighting effect.

In an embodiment, a master controller, such as controller 120*a* provides commands to subcontrollers 120*b*, which each command a plurality of secondary controllers 122. In an embodiment, each light element 154 is associated with a data address for further control of individual light elements 154. In other embodiments, no such address is required.

The algorithms and software for such lighting effects may be pre-programmed into any of the controllers, and/or may be received by wireless receiver 130 via a remote control device. The remote control device may be used to transmit such programming to tree 100 wirelessly. In an embodiment, a remote control device may comprise any type of computer for creating and/or transmitting light control programs to tree 100.

In addition to light-control programming, tree 100 may also include audible or musical programming. In an embodiment tree 100 includes a speaker, which may be in wired or wireless communication with tree 100 and in some embodiments, master controller 120.

Consequently, tree 100 of FIGS. 1-14 includes multiple controllers and an efficient wiring distribution system for creating a wide variety of visual and audible displays. 124

Figure 15:
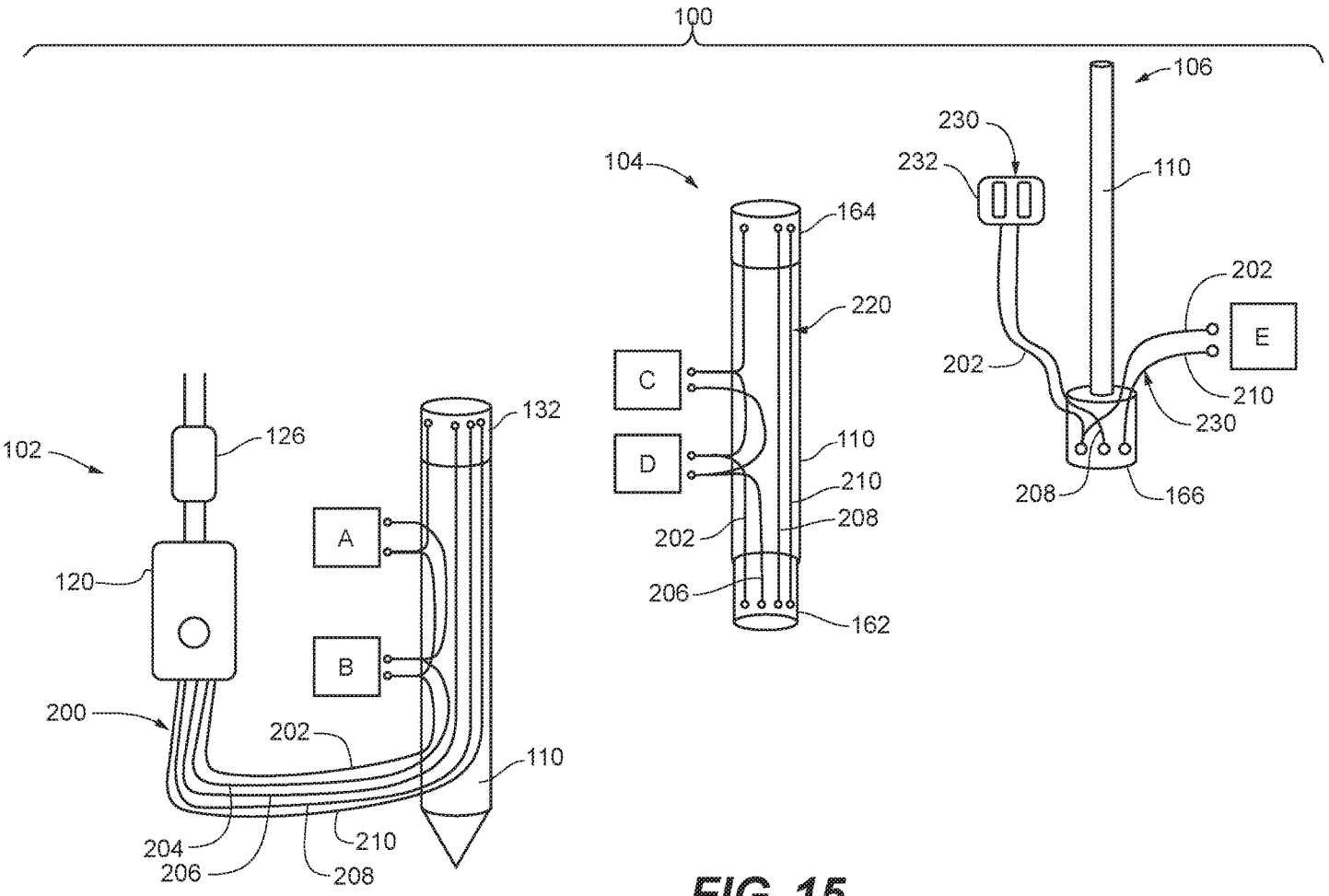
FIG. 15 depicts a single-controller tree configured for 3-way lighting control, according to an embodiment.
Figure 17:
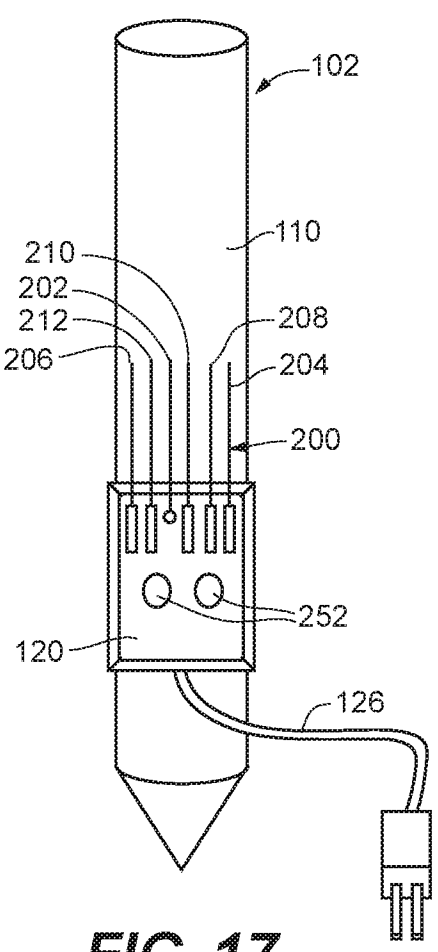
FIGS. 16-17 depict a single-controller tree section configured for 5-way lighting control, according to embodiments.
Figure 16:
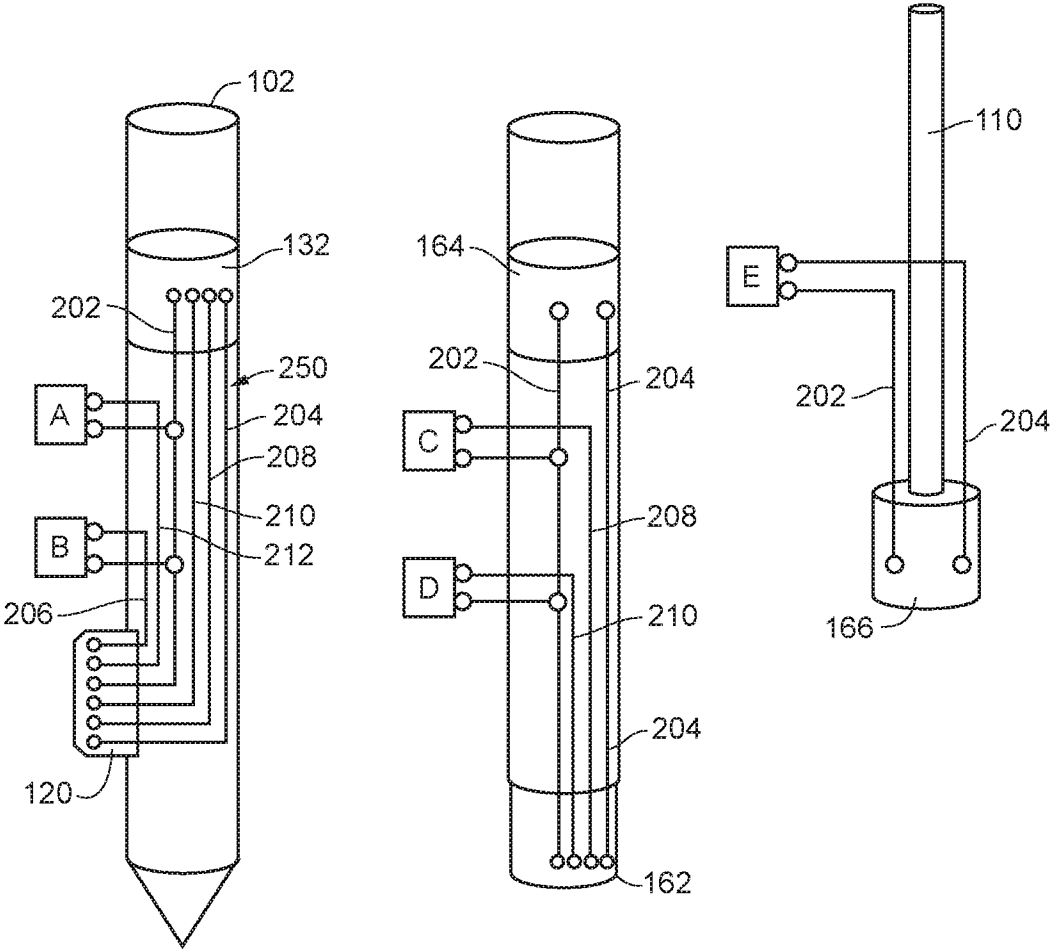

Referring to FIGS. 15-17, single controller embodiments of tree 100 are depicted.

Referring specifically to FIG. 15, single-controller embodiments of tree sections 102, 104, and 106 configured for "3-way" control of light elements, and with an accessory power plug, are depicted. "3-way" control means independent electrical control over three groups, sets, or items, such as three groups of light elements 154, or three groups of light assemblies 118, or three groups, each group consisting of multiple sets of light assemblies 118, such that power to a first group can be manipulated independent of how either of the other two groups are powered or manipulated. In this embodiment, power is transmitted throughout all three tree sections 102, 104, and 106. Further, each individual tree section is powerable separately from the other tree sections. In other words, power to light elements of tree section 102 may be controlled exclusive of power to light elements of tree sections 104 and 106. Similarly, light elements of tree sections 104 and 106 may be controlled independent of the other tree sections. The unique combination of controller, wiring scheme, and trunk electrical connectors enable such features.

In an embodiment, first tree section 102 includes power plug 126, which may be configured for AC or DC operation, controller 120, trunk portion 110, trunk electrical connector 132, wire set 200, light set A and light set B.

Wire set 200, in an embodiment comprises conductors 202, 204, 206, 208, and 210 extending within trunk portion 110. In an embodiment, conductor 202 may comprise a set of conductors, which may comprise a first power polarity, such as ground or neutral. Conductor 202 may be common to all light elements of tree 100 and any other electronic devices of tree 100.

In an embodiment, conductors 204, 206, 208, and 210 each transmit a power signal. As depicted, conductor 204 is electrically connected to light sets A and B, such that together, conductor 202 and 204 provide power to light sets A and B.

Conductors 206, 208, and 210 extend to trunk electrical connector 132, as does conductor 202, such that trunk electrical connector 132 comprises a 4-pin connector, which in an embodiment, includes a common ground/neutral/negative terminal, and three separately controllable power/live/positive terminals.

Light sets A and B are depicted in block form, and are understood to comprise any variety of light elements 154 as described above; the light elements 154 being connected electrically in any configuration, including in series, parallel, parallel-series, and series-parallel.

In such an embodiment, individual light elements 154 are not individually controllable, though light elements 154 of independent tree sections are controllable as a group.

Tree section 104 includes a trunk portion 110, electrical connector 162, wire set 220, trunk electrical connector 162, trunk electrical connector 164 and light sets C and D. Wire set 220 comprises conductors 202, 206, 208, and 210. Light sets C and D are electrically connected to conductors 202 and 206, which transmit power to light elements of the light sets.

Trunk electrical connector 162 is a 4-terminal connector configured to electrically connect to 4-pin trunk electrical connector 132.

Conductors 202, 208, and 210 extend within trunk portion 110 to trunk electrical connector 164.

Light sets C and D are controlled by controller 120 which selectively powers light sets C and D together via selective powering of conductor 206.

Tree section 106 includes a trunk portion 110, which may be narrower than trunk portions 110 of tree sections 102 and 104, trunk electrical connector 166, wire set 222, light set E, and accessory power plug assembly 230.

Wire set 222, in an embodiment, comprises conductors 202, 208, and 210.

Trunk electrical connector 166, in an embodiment, comprises a 3-terminal, or 3-pin, electrical connector.

Conductors 202 and 210 provide power to light set E, while conductors 202 and 208 provide power to accessory power plug 230.

Accessory power plug assembly 230 provides power to accessory items like tree top ornaments, musical ornaments, and so on. In an embodiment assembly 230 provides power that is different than the power provided to light sets A-E; in an embodiment assembly 230 provides power that is the same as the power provided to light sets A-E. Conductors 202 and 208 may comprise a length sufficient to locate the plug end 232 of assembly 230 a predetermined distance from trunk portion 110. In an embodiment, conductors 202 and 208 may each extend 0.5 ft to 2 ft from trunk portion 110, providing sufficient length to be connected to a powered accessory. In an embodiment, conductors 202 and 208 extend a length that is 50% to 100% of the length of trunk portion 110, so as to provide power to a powered accessory mounted atop trunk portion 110 of tree section 106.

As described in part above, in operation, controller 120 controls groups of light sets or light elements by selectively powering any combination of conductors 204, 206, 208, or 210 to create flashing, fading, on/off or other visual effects.

As also described above, the multi-way control of light sets and tree sections is accomplished by having a tiered trunk electrical connector system, whereby the number of controllable power conductors 204-210, and the number of terminals per trunk electrical connector, decreases from a first tree section to the adjacent, then more distal tree sections. In other words, trunk electrical connectors 132 and 162 are 4-terminal connectors forming a first coupling point between tree section 102 and 104, while trunk electrical connectors 164 and 166 are 3-terminal connectors forming a second coupling point between tree sections 104 and 106. In an embodiment not including accessory power plug assembly 230, trunk electrical connectors 164 and 166 may comprise 2-terminal trunk electrical connectors.

For trees 100 having additional tree sections, or for additional control, the number of terminals of trunk electrical connectors would be increased at each junction, but would decrease for each coupling point further away from controller 120.

Referring to FIGS. 16 and 17, a single controller, 5-way controlled tree 100 is depicted. This embodiment of tree 100 is substantially similar to the 3-way tree 100 of FIG. 15, though tree 100 of FIGS. 16 and 17 allows for control over a greater number of light element groups (or other powered devices). In an embodiment, and as depicted, tree 100 includes tree sections 102, 104, and 106, and is based on a single controller configured to control five pairs of conductors corresponding to five groups of light elements. FIG. 16 is a front perspective view of three tree sections 102, 104, and 106; FIG. 17 is a left-side perspective view of tree section 102.

Referring still to FIGS. 16 and 17, tree section 102 comprises trunk portion 110, controller 120, power cord 126, trunk electrical connector 132, wire set 250 and light sets A and B.

Wire set 250 includes conductor 202, which may comprise a common ground, neutral, or negative conductor comprising one of a pair of power conductors, and multiple electrically live or positive conductors 204, 206, 208, 210 and 212. As depicted, wire set 202 includes five such positive polarity conductors, though in other embodiments, it will be understood that more or fewer such conductors may be used. Conductors 202 and 212 provide power to light set A; conductors 202 and 206 provide power to light set B.

Controller 120 is configured to selective power any combination of conductors 204, 206, 208, 210, and 212. As depicted, controller 120 may be mounted directly to trunk portion 110, and may include integral push buttons 252 for selecting light display features or programs of controller 120.

Trunk electrical connector 132 comprises a 4-terminal connector.

Tree section 104 comprises 4-terminal connector 162 and two-terminal trunk electrical connector 164. Conductors 202 and 208 provide power to light set C; conductors 202 and 210 provide power to light set D. Power for tree section 106 is transmitted via conductors 202 and 204 from connector 162 to 164.

Tree section 106 comprises trunk portion 110, 2-terminal trunk electrical connector 166, wire set 260 comprising conductors 202 and 204, and light set E. Light set E is powered by conductors 202 and 204.

As described in part above, the combination of the wiring layout and use of different types of trunk electrical connectors enables independent control of each of light sets A-E, such that various lighting displays may be created and implemented.

Figure 20:
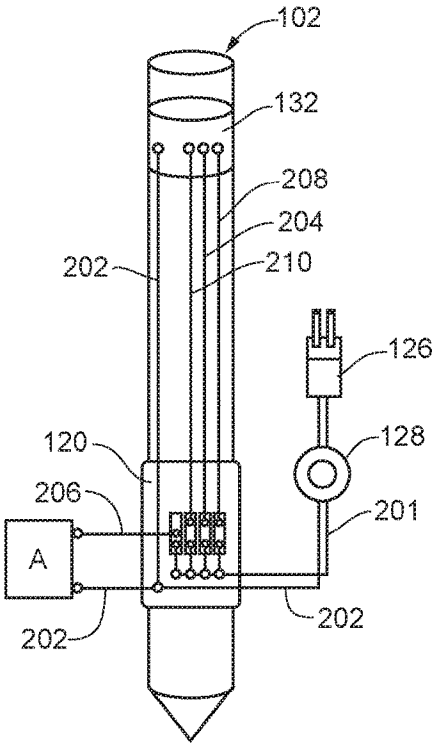
FIGS. 18-20 depict single-controller tree sections, according to embodiments.
Figure 19:
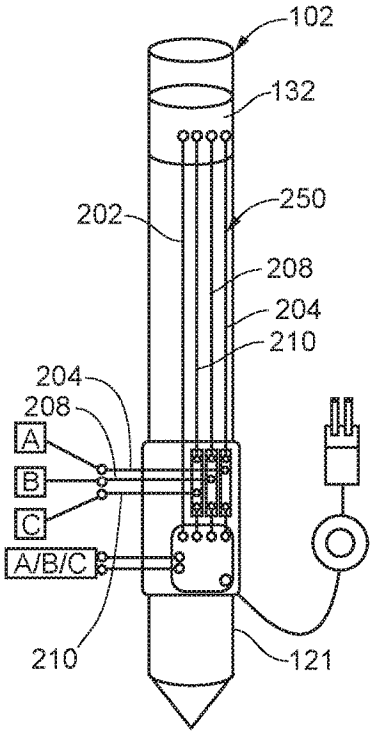
Figure 18:
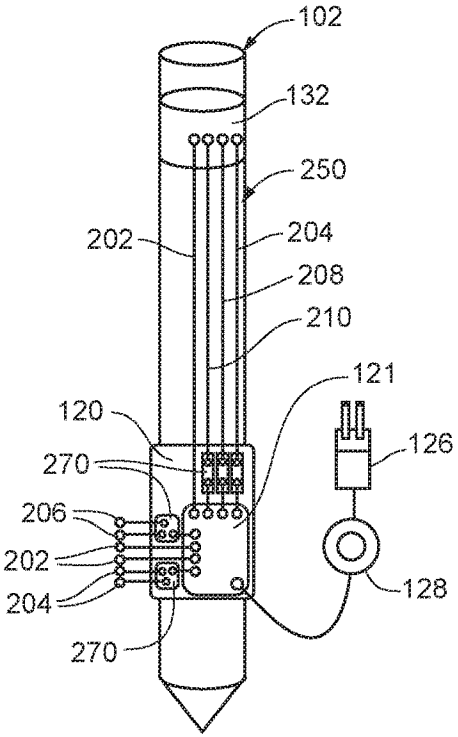

Referring to FIGS. 18-20, embodiments of tree section 102 for a single controller tree 100 are depicted.

Referring specifically to FIG. 18, tree section 102 is configured for 5-way control, similar to tree section 102 as depicted in FIG. 17. FIG. 18 shows additional detail.

In this embodiment, controller 120 includes processor 121 and multiple terminal blocks 270 for electrically connecting processor 121 to conductors 202-210. Also in this embodiment, additional conductors are depicted allowing additional light sets to be powered by tree section 102.

Further, power cord 126 and control switch 128 are combined. In an embodiment, control switch 128 selectively turns power received through power cord 126 on and off.

FIG. 19 depicts another embodiment of tree section 102, and comprises controller 120 with terminal blocks 170, and wire set 280. In this configuration, controller 120 and wire set 280 are configured for 3-way operation. Tree section 102 of FIG. 19 differs from tree section 102 of FIG. 15 in that each tree section 102, 104, and 106 has each of conductors 204, 208, and 210, such that each tree section has three pairs of controllable power pairs. In such an embodiment, three light sets, such as light set A, B, and C (not depicted) may be controlled on each tree section.

Alternatively, each conductor 204, 208, and 210 can electrically connect to a multi-lamp light element, such an RGB LED, of a set of multi-lamp light elements, thereby controlling the color of the lamp.

Referring to FIG. 20, another embodiment of tree section 102 is depicted. In this embodiment, on/off control is accomplished via switch 128. Power is conducted through conductors 201 and 202. Power to a light set A, or other powered device, is transmitted or conducted through conductors 202 and 206. Conductor 201 is in electrical connection with conductors 204, 208, and 210, transmitting power over three conductors and one neutral conductor via connector 132.

Figure 21:
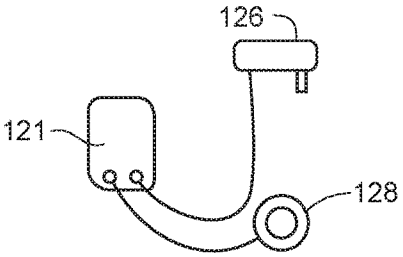
FIG. 21 depicts a control switch and power plug connected to a controller, according to an embodiment.

FIG. 21 depicts an alternate embodiment of control switch 128 and power plug 126 connected to a processor 121. In such a configuration, processor 121 receives power from plug 126, and reacts to control signals from switch 128.

FIGS. 22-26 depict alternate embodiments of tree section 104 of a single-controller tree 100, wherein controller 120 is no longer located in tree section 102, but rather is located in tree section 104. Such a configuration allows for greater control of light sets and tree sections, as well as facilitating standard, more efficient wire layouts. As depicted, a tree configured with tree section 100 can utilize all 4-terminal conductors, yet accomplish 9-way control via nine control outputs from the processor or controller 120 controlling nine different conductors 300-316. Conductors 202 serve as a common, ground, or neutral conductors.

In this configuration, three groups of light sets on tree section 104 are powered by power conductor pairs (202, 306), (202,308), and (202, 310); three groups of conductors provide power to tree section 102: (202, 312), (202, 314), and (202, 316); and three groups of conductors provide power to tree section 106: (202, 300), (202, 302), and (202, 304).

Although nine selectively controlled conductors of a second polarity are depicted, it will be understood that the number of conductors can be more or fewer for greater or lesser control of powered light sets and devices.

As compared to placing controller 120 in the lower tree section, placing controller 120 in a middle tree section allows for greater control without having to use a great number of terminals in the trunk electrical connectors. If 9-way control was desired in a controller connected in a non-central or middle tree section, trunk electrical connector 132 would need to comprise 7 terminals, which would possibly require larger than normal trunk diameters, and could cause problems with arcing or shorting between terminals as the terminals would necessarily be placed close to one another due to the limited space.

Figure 23:
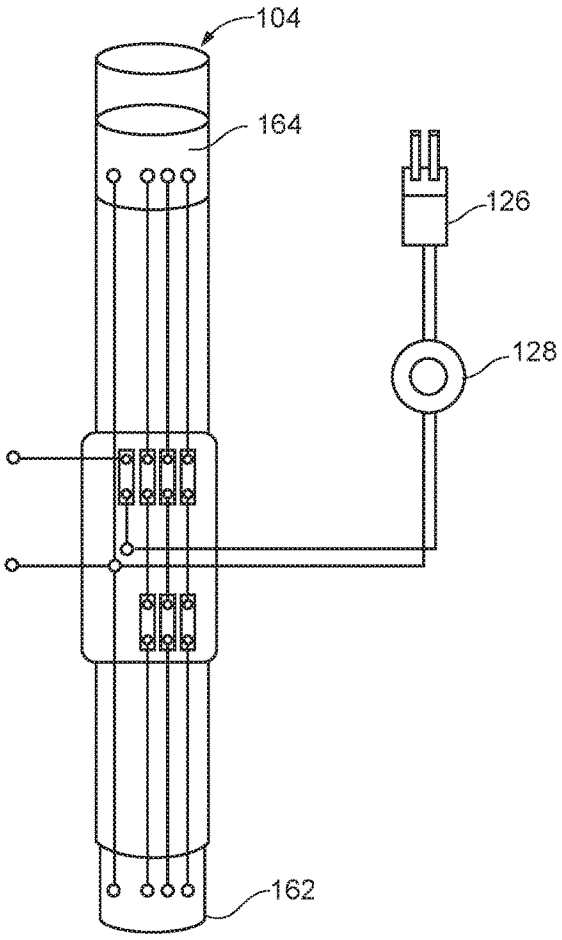
FIGS. 22-26 depict tree sections having a controller in a middle tree section, according to an embodiment.

FIG. 23 depicts another embodiment of a tree section 104 having a middle hub or connector system.

Figure 22:
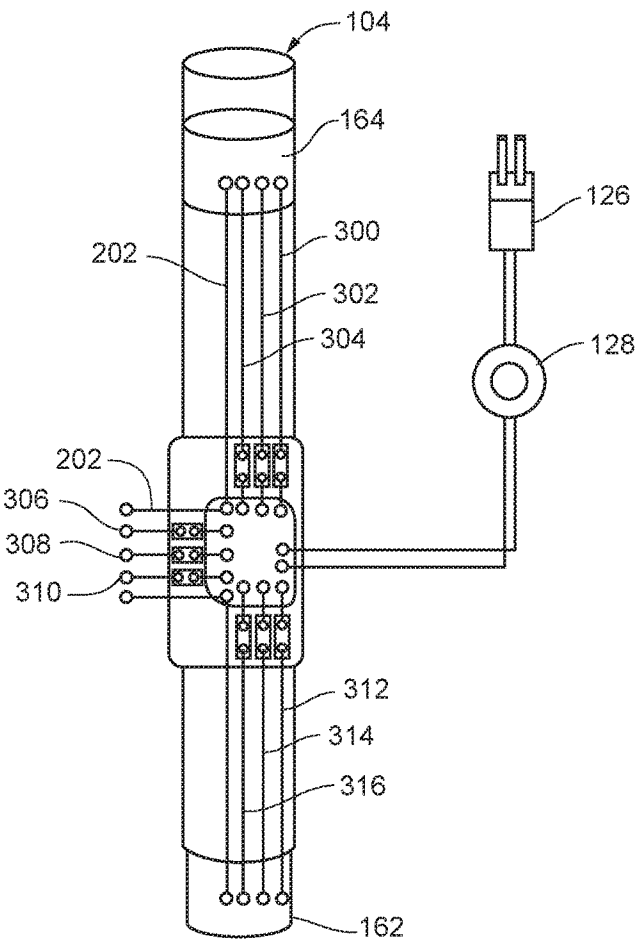
Figure 24:
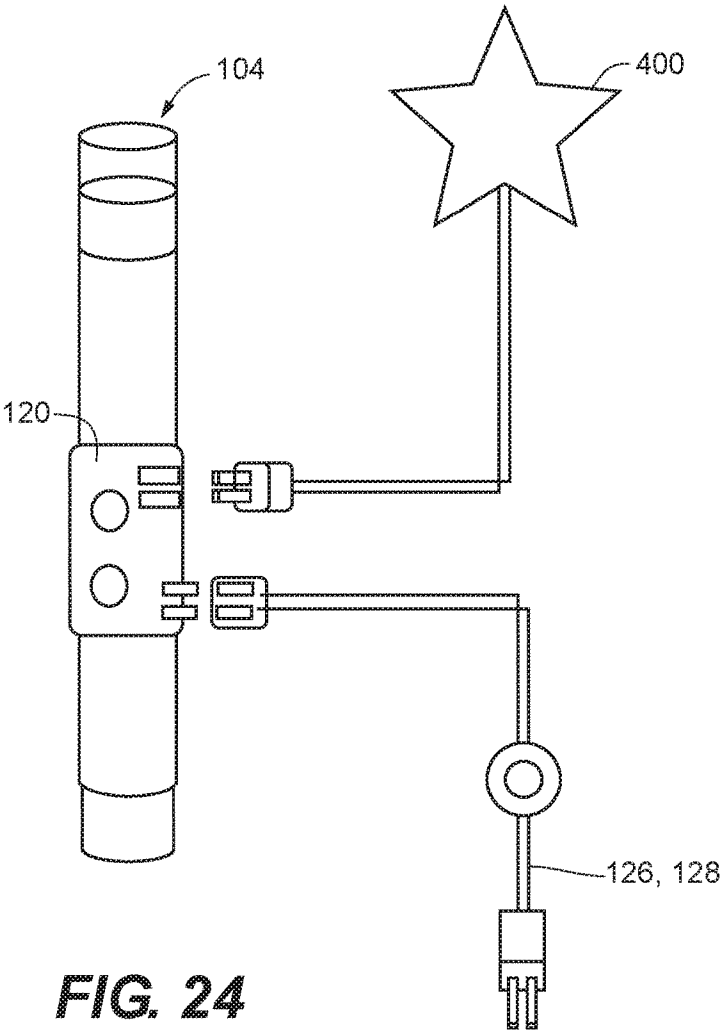

FIG. 24 depicts an embodiment of tree section 104, which may be substantially the same as tree section 104 of FIG. 22, with the addition of removable, locking, or otherwise non-integrated power plug/switch combination 126/128 and powered accessory 400. In this embodiment, optional powered accessory 400 comprises a lighted tree top ornament, and a power outlet at controller 120.

Figure 25:
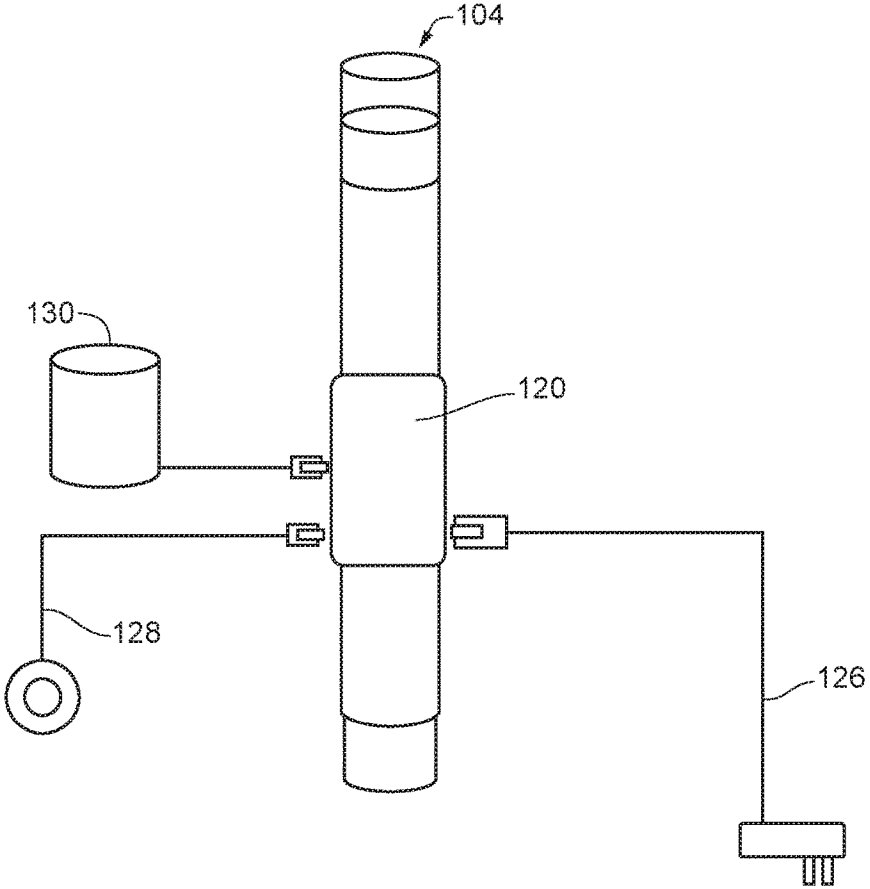

FIG. 25 depicts an embodiment of tree section 104 with optional wireless receiver 130, switch 128 and cord 126, any of which may be modular and/or detachably received by controller assembly 120.

Figure 26:
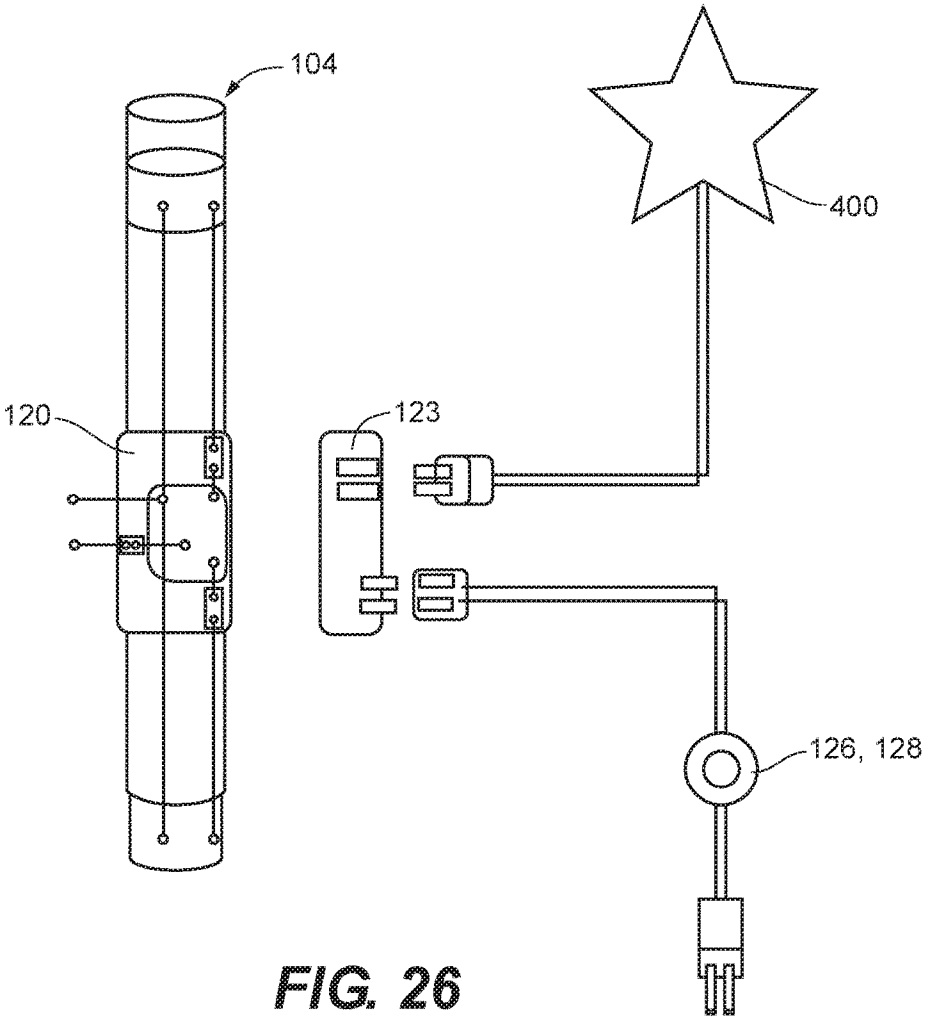

FIG. 26 depicts tree section 104 configured for 3-way control: lights of tree section 102, 104, and 106 are controlled independent of other sections, e.g., tree section 102 may be turned on and off, faded, or otherwise controlled independent of power to other tree sections. Further, such control is accomplished via 2-terminal trunk electrical connectors 132 and 162, rather than 4-terminal connectors.

Further, controller 120 is modular and includes detachable portion 123 for receiving various embodiments of switch/power cord combination 126/128 and powered accessory 400.

Embodiments of the invention also include methods of controlling light elements of a lighted artificial tree as described herein.

The embodiments above are intended to be illustrative and not limiting. Additional embodiments are within the claims. In addition, although aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed:

1. An artificial color-changing tree for powering and controlling electrically powered lighting elements, comprising:

a power cord configured to conduct alternating-current (AC) power electrically connected to a transformer configured to transform AC power to DC power;

a foot-operated switch;

a primary controller including a processor;

a first tree section including:

a first trunk portion;

a first plurality of branches coupled to the first trunk portion;

a first plurality of lighting elements distributed about the first plurality of branches, each of the lighting elements including at least one red-green-blue (RGB) diode set comprising a red light-emitting diode (LED), a green LED, and a blue LED;

a first plurality of lighting-element controllers configured to control the first plurality of lighting elements, including the RGB diode sets;

a first trunk electrical connector inserted at least partially into the first trunk portion and including a plurality of electrical terminals for conducting power, data, or both power and data;

a first set of power wires in electrical connection with the plurality of electrical terminals of the first trunk electrical connector and wherein the first set of power wires and the first plurality of lighting elements are in electrical connection with the first primary controller and at least one of the plurality of electrical terminals of the first trunk connector, wherein the primary controller is configured to communicate with the first plurality of lighting-element controllers;

a second tree section, including:

a second trunk portion;

a second plurality of branches coupled to the second trunk portion;

a second plurality of lighting elements distributed about the second plurality of branches, each of the second plurality of lighting elements including at least one red-green-blue (RGB) diode set comprising a red light-emitting diode (LED), a green LED, and a blue LED;

a second plurality of lighting-element controllers configured to control the second plurality of lighting elements, including the RGB diode sets;

a second trunk electrical connector inserted at least partially into the second trunk portion and including a plurality of electrical terminals, the plurality of electrical terminals configured to electrically connect to the plurality of electrical terminals of the first trunk connector, wherein the primary controller is configured to communicate with the second plurality of lighting-element controllers through the first trunk electrical connector and the second trunk electrical connector;

wherein the first tree section is configured to couple to the second tree section such that the first trunk electrical connector engages the second trunk electrical connector enabling power to be transmitted from the first tree section to the second tree section, and enabling data from the primary controller to be transmitted to the second tree section, and wherein the power cord, the foot-operated switch, the transformer, and the primary controller are external to the first trunk portion, the foot-operated switch being configured to select a color of the first plurality of lighting elements and the second plurality of lighting elements.

2. The artificial color-changing tree of claim 1, wherein the foot-operated switch is configured to selectively interrupt AC power between the power cord and the transformer.

3. The artificial color-changing tree of claim 1, wherein the foot operated-switch is removably connected to a power interface portion of the primary controller.

4. The artificial color-changing tree of claim 1, wherein at least one of the transformer and the primary controller are mounted to an exterior surface of the first trunk portion.

5. The artificial color-changing tree of claim 4, wherein the transformer is mounted to the exterior surface of the first trunk portion.

6. The artificial color-changing tree of claim 1, wherein a wireless receiver is electrically connected to the primary controller.

7. The artificial color-changing tree of claim 6, wherein the wireless receiver is mounted to an exterior surface of the first trunk portion.

8. The artificial color-changing tree of claim 6, wherein the wireless receiver is configured to control a color of the plurality of lighting elements.

9. The artificial color-changing tree of claim 6, wherein the wireless receiver is configured to receive operating instructions from a remote device.

10. The artificial color-changing tree of claim 1, wherein two or more lighting elements are configured to be controlled as a group.

11. An artificial color-changing tree for powering and controlling electrically powered lighting elements, comprising:

an external control system including:

a power cord;

a transformer;

a foot-operated switch; and a primary controller including a processor;

a first tree section including:

a first trunk portion;

a first plurality of branches coupled to the first trunk portion;

a first plurality of lighting elements distributed about the first plurality of branches each of the lighting elements including a plurality of light emitting diodes (LEDs) comprising a red LED, a green LED, and a blue LED;

a first trunk electrical connector inserted at least partially into the first trunk portion and including a plurality of electrical terminals for conducting power, data, or both power and data;

a first set of power wires in electrical connection with the plurality of electrical terminals of the first trunk electrical connector and wherein the first set of power wires and the first plurality of lighting elements are in electrical connection with the external control system and at least one of the plurality of electrical terminals of the first trunk connector, wherein the external control system is configured to control at least a first plurality of lighting-element controllers wherein the first plurality of lighting-element controllers are configured to control the RGB diode sets of the first plurality of lighting elements;

a second tree section, including:

a second trunk portion;

a second plurality of branches coupled to the second trunk portion;

a second plurality of lighting elements distributed about the second plurality of branches each of the lighting elements including a plurality of light emitting diodes (LEDs) comprising a red LED, a green LED, and a blue LED; and a second trunk electrical connector inserted at least partially into the second trunk portion and including a plurality of electrical terminals, the plurality of electrical terminals configured to electrically connect to the plurality of electrical terminals of the first trunk connector, wherein the external control system is configured to control at least a second plurality of lighting-element controllers, and wherein the second plurality of lighting-element controllers are configured to control the RGB diode sets of the second plurality of lighting elements;

wherein the first tree section is configured to couple to the second tree section such that the first trunk electrical connector engages the second trunk electrical connector enabling power to be transmitted from the first tree section to the second tree section, and enabling data from the external control system to be transmitted to the second tree section, and wherein the external control system is configured to control a color of the plurality of lighting elements.

12. The artificial color-changing tree of claim 11, wherein each of the lighting elements are wired to be controlled individually.

13. The artificial color-changing tree of claim 11, wherein the trunk electrical connector is a 4-terminal connector.

14. The artificial color-changing tree of claim 11, wherein the trunk electrical connector is a 3-terminal connector.

15. The artificial color-changing tree of claim 11, wherein the external control system comprises accessory conductors extending a length that is 50 to 100% of a combined length of the first and second trunk portions.

16. The artificial color-changing tree of claim 15, wherein the accessory conductors are configured to provide power to an accessory associated with the tree.

* * * * *